US009358476B2

(12) United States Patent
Uno

(10) Patent No.: US 9,358,476 B2
(45) Date of Patent: Jun. 7, 2016

(54) CONNECTABLE BLOCK

(75) Inventor: Yasumasa Uno, Osaka (JP)

(73) Assignee: Artec Co., Ltd., Osaka (JP)

( * ) Notice: Subject to any disclaimer, the term of this patent is extended or adjusted under 35 U.S.C. 154(b) by 140 days.

(21) Appl. No.: 13/607,964

(22) Filed: Sep. 10, 2012

(65) Prior Publication Data

US 2013/0203316 A1 Aug. 8, 2013

Related U.S. Application Data

(63) Continuation of application No. PCT/JP2012/052600, filed on Feb. 6, 2012.

(51) Int. Cl.
*A63H 33/08* (2006.01)

(52) U.S. Cl.
CPC ..... *A63H 33/086* (2013.01)

(58) Field of Classification Search
CPC ..... A63H 33/08; A63H 33/04; A63H 33/088; A63H 33/108; A63H 33/044; A63H 33/067; A63H 33/06; A63H 33/062; A63H 33/065; A63H 17/264
USPC ..... 446/124
See application file for complete search history.

(56) References Cited

U.S. PATENT DOCUMENTS

| | | | | | |
|---|---|---|---|---|---|
| 3,577,671 | A * | 5/1971 | Woollett | 446/124 |
| 3,905,150 | A * | 9/1975 | Dawn | 446/124 |
| 4,306,373 | A * | 12/1981 | Chatani et al. | 446/121 |
| 4,678,192 | A | 7/1987 | Campbell | |
| 5,106,093 | A * | 4/1992 | Engel | 273/160 |
| 6,679,780 | B1 * | 1/2004 | Shih | 273/157 R |
| 2005/0044783 | A1 | 3/2005 | Craig | |

FOREIGN PATENT DOCUMENTS

| | | |
|---|---|---|
| JP | 49-41435 | 11/1974 |
| JP | 939645 C | 1/1979 |
| JP | 202534240 A | 10/2002 |
| JP | 2005342357 A | 12/2005 |
| JP | 2010279671 A | 12/2010 |
| WO | WO 93/17767 | 9/1993 |

* cited by examiner

*Primary Examiner* — Melba Bumgarner
*Assistant Examiner* — Amir Klayman
(74) *Attorney, Agent, or Firm* — Robert P. Michal, Esq.; Carter, DeLuca, Farrell & Schmidt, LLP

(57) ABSTRACT

To provide a block having a simple shape by itself with which various three-dimensional structures can be obtained by devising connection states, the invention is directed to a regular hexahedral block connectable with at least another block by fitting a protrusion provided on a surface of one of the blocks into a recessed portion provided in a surface of the other block, in which one protrusion having a square cross-sectional shape is formed at the center in one quarter section of a surface of the regular hexahedron, and in which a recessed portion into which the protrusion is fittable is formed at the center in each of two to four quarter sections of any other three surfaces of the regular hexahedron.

3 Claims, 8 Drawing Sheets

CONNECTABLE BLOCK

CROSS-REFERENCE TO RELATED APPLICATION

This is a Continuation of International Application PCT/JP2012/052600 filed Feb. 6, 2012, the entire contents of which is incorporated herein by reference.

TECHNICAL FIELD

The present invention relates to blocks connectable to each other to form various three-dimensional shapes by preparing a number of such blocks and repeating the operation of fitting protrusions provided on the surface of one block into recessed portions provided in the surface of the other blocks.

BACKGROUND ART

Blocks connectable to each other to form various three-dimensional shapes are widely known such as disclosed in Patent Document 1 below, in which multiple (e.g. four to eight) protrusions are formed on the top surface of a rectangular parallelepiped block and recessed portions into which the respective protrusions are fittable are formed in the bottom surface parallel to the top surface.

RELATED ART DOCUMENT

Patent Document

[Patent Document 1] Japanese Translation of PCT International

SUMMARY OF THE INVENTION

Problems to be Solved by the Invention

The block disclosed in Patent Document 1 above, in which multiple protrusions are merely formed on the top surface, is easy to stack and connect without thinking and does not require any significant thought process, lacking in intellectual training and game elements.

Neither protrusion nor recessed portion is formed on the side surfaces, which makes it difficult to obtain various connection states.

There have also been proposed other types of blocks having protrusions and recessed portions formed on the side surfaces thereof, but having multiple protrusions formed on the top surface or even one protrusion at the center of the top surface, with which simple connection structures can be obtained but complex connection structures requiring a thought process cannot be obtained easily. All such blocks are thus lacking in intellectual training and game elements.

It is hence an object of the present invention to provide a block having a simple shape by itself with which various three-dimensional structures can be obtained by devising connection states.

Means for Solving the Problems

The present invention is directed to a hexahedral block connectable with at least another block by fitting a protrusion provided on a surface of one of the blocks into a recessed portion provided in a surface of the other block, in which one protrusion is formed on at least one surface of the hexahedron at a position displaced from the center of the surface, and in which at least one recessed portion is formed in at least another surface of the hexahedron at a position displaced from the center of the surface.

The hexahedron may be a regular hexahedron.

Further, the protrusion may be provided at the center in one quarter section of one of the six surfaces, and the recessed portion may be provided at the center in one quarter section of at least one of the other five surfaces.

Further, the at least one recessed portion may be provided in each of the other five surfaces.

Further, the recessed portion may be provided at the center in each of two quarter sections of the one surface.

Further, the recessed portion may be provided at the center in each of three quarter sections of the one surface.

Further, the recessed portion may be provided at the center in each of four quarter sections of the one surface.

Further, the protrusion may have a square cross-sectional shape, and the recessed portion may include four inner wall surfaces and may have a cross-sectional shape into which the protrusion is fittable.

Further, a rib may be formed on at least one of the inner wall surfaces of the recessed portion.

In accordance with the connectable block according to the present invention, at least one surface of the hexahedron has only one protrusion formed thereon, which requires a profound spatial thought process to obtain complex three-dimensional structures, exhibiting a beneficial effect on spatial recognition and intellectual training. In addition, since the one protrusion is formed at a position displaced from the center of the surface, various connection structures can be obtained depending on into which recessed portion of another block to fit the protrusion.

The connectable block according to the present invention thus requires a thought process for profound spatial recognition to obtain various three-dimensional shapes, providing good intellectual training and game elements.

In addition, since recessed portions are formed also in the side surfaces, various connection states can be obtained.

The present invention thus provides a connectable block having a simple shape by itself with which various three-dimensional structures can be obtained by devising connection states.

MODES FOR CARRYING OUT THE INVENTION

Connectable blocks according to preferred embodiments of the present invention will hereinafter be described with reference to the accompanying drawings.

Figure 1:
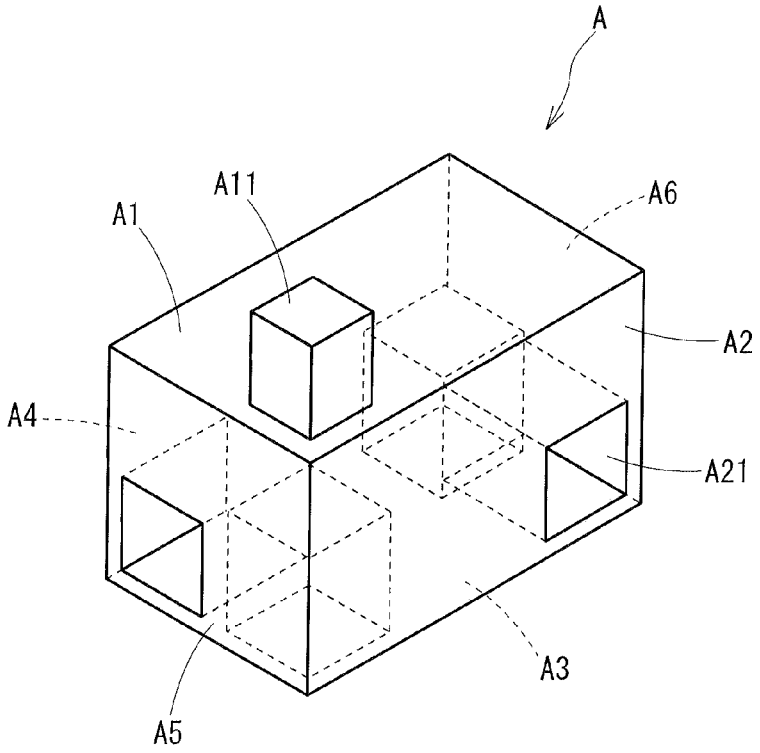
FIG. 1 is a perspective view of a connectable block according to the present invention.

FIG. 1 shows a hexahedral block A according to the present invention, connectable with at least another block by fitting a protrusion provided on a surface of one of the blocks into a recessed portion provided in a surface of the other block. In this figure, the top surface is defined as a first surface A1, the side surface to the immediate right of the first surface A1 is defined as a second surface A2, the bottom surface is defined as a third surface A3, the side surface to the immediate left of the first surface A1 is defined as a fourth surface A4, the front surface is defined as a fifth surface A5, and the back surface is defined as a sixth surface A6.

Among the six surfaces, at least the first surface A1 has a protrusion A11 formed thereon, and at least the second surface A2, one of the other five surfaces, has a recessed portion A21 formed therein.

The protrusion A11 is formed at a position displaced from the center of the first surface A1, and the recessed portion A21 is also formed at a position displaced from the center of the second surface A2.

The protrusion A11 has a columnar (e.g. square) cross-sectional shape, and the recessed portion A21 has a shape and size into which the protrusion A11 is fittable.

The hexahedron A is preferably, but may not be, a regular hexahedron. Two adjacent surfaces are preferably orthogonal to each other to assemble regular solids, but may not be orthogonal.

Only one protrusion may be formed on at least one of the six surfaces. Alternatively, two or more protrusions may be formed on one or two or more surfaces.

One, two, three, or four protrusions may be formed on the first surface A1. In the case of two, the protrusions are preferably provided diagonally on the surface, but may be arranged adjacently. In the case of three or fewer protrusions, a recessed portion may or may not be formed.

One, two, three, or four recessed portions A21 may be formed in the second surface A2. In the case of two, the recessed portions are preferably provided diagonally in the surface, but may be arranged adjacently. In the case of three or fewer recessed portions, a protrusion may or may not be formed.

If both at least one protrusion and at least one recessed portion are formed on one surface and in the case of one protrusion, one, two, or three recessed portions may be formed. In the case of two protrusions, one or two recessed portions may be formed. In the case of three protrusions, one recessed portion may be formed.

First Embodiment

Figure 2:
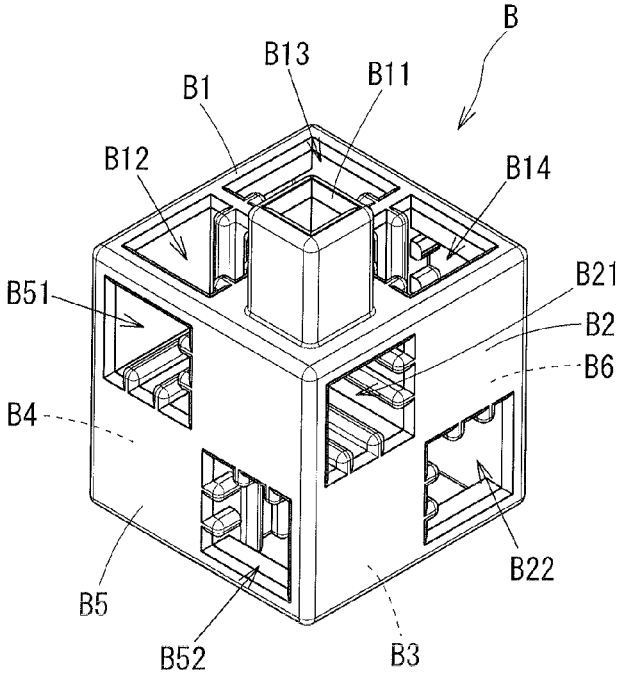
FIG. 2 is a perspective view of a connectable block according to a first embodiment.
Figure 3:
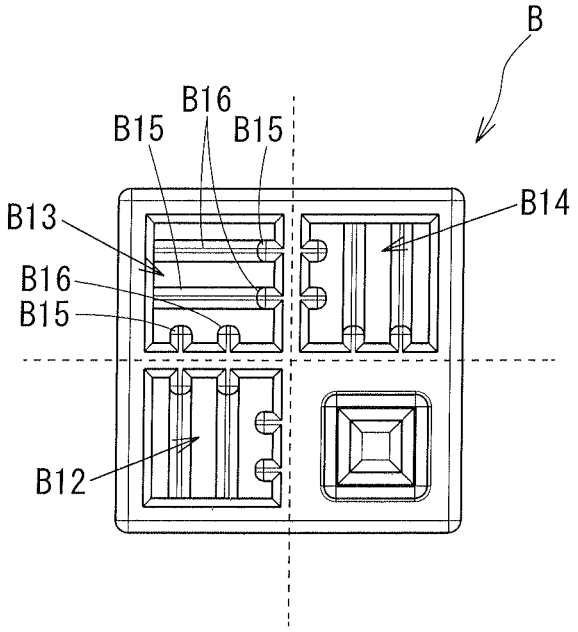
FIG. 3 is a plan view of the connectable block according to the first embodiment.
Figure 4A:
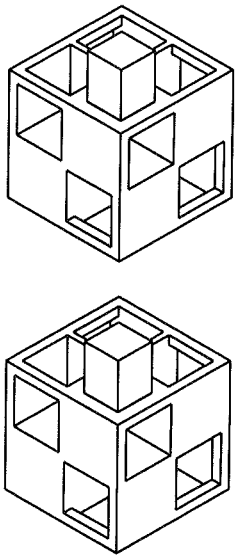
FIGS. 4(A)-4(E) illustrate connection structures of the connectable block according to the first embodiment.
Figure 4B:
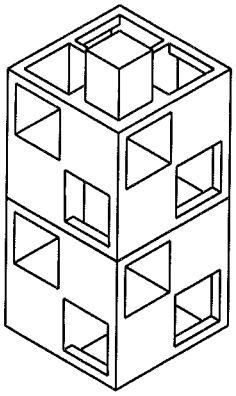
Figure 4C:
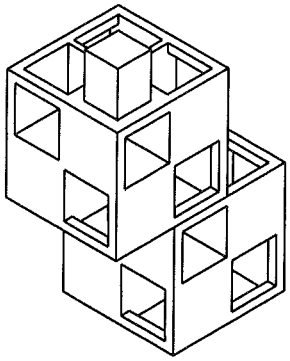
Figure 4D:
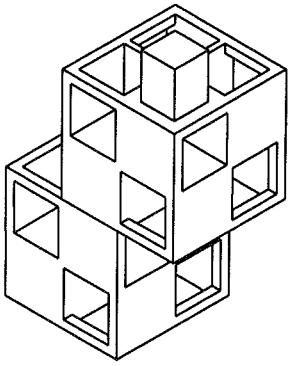
Figure 4E:
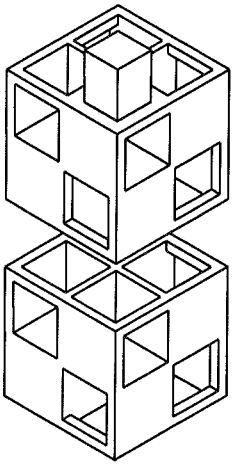

A block according to a first embodiment of the present invention will hereinafter be described with reference to FIGS. 2 and 3.

The block B according to the first embodiment is a regular hexahedral one, in which a protrusion B11 is provided at the center in one quarter section (quartered along the dashed lines shown in FIG. 3) of a first surface B1, one of the six surfaces, while recessed portions B12, B13, and B14 having a size into which a protrusion having the same shape and size as the protrusion B11 and formed on another block having the same shape is fittable are provided at the center in the other three quarter sections.

In each of the other five surfaces, recessed portions having a size into which the protrusion is fittable are provided at the center in two or four quarter sections.

The block B may be composed of any selective material such as PP resin or ABS resin.

The protrusion A11 is a quadrangular columnar one having a square cross-sectional shape, and the recessed portions B12, B13, and B14 have a shape and size into which the protrusion A11 can be inserted. It is noted that the ratio of the height of the protrusion A11 to the length of each side of the block B is not limited to the example shown but may be smaller.

The recessed portion B12 includes four inner wall surfaces, and two lines of ribs B15 and B16 are formed on each of adjacent two of the four inner wall surfaces and the bottom surface of the recessed portion.

Therefore, the recessed portion B12 is formed wider by the height of the ribs B15 and B16. These ribs B15 and B16 cause the protrusion to be inserted and fitted tightly into the recessed portion B12, preventing excessive looseness or excessive tightness making it difficult to attach or detach the protrusion. The other recessed portions B13 and B14 are arranged in the same manner as the recessed portion B12.

In the case of blocks including no rib, the recessed portions have a shape and size into which the protrusion is just fittable.

FIG. 4 illustrates cases of stacking and connecting two such blocks B as arranged above. Depending on into which one of the four recessed portions in the upper block to fit the protrusion on the lower block in FIG. 4(A), various connection states can be obtained such as aligned shown in FIG. 4(B) and misaligned shown in FIGS. 4(C), 4(D), and 4(E).

Four types of different connection states can thus be obtained and, by combining these states, various types of connection structures can also be obtained.

Figure 5A:
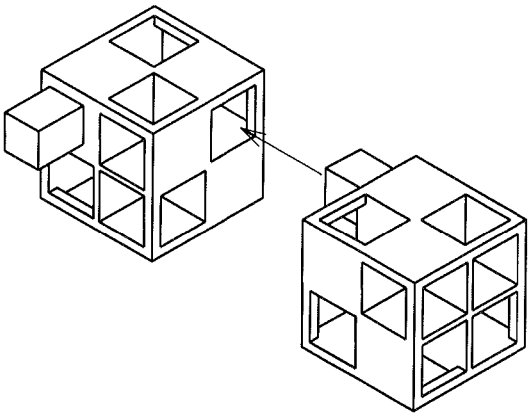
FIGS. 5(A)-5(B) illustrate connection structures of the connectable block according to the first embodiment.
Figure 5B:
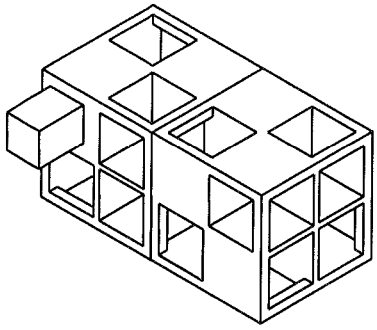

FIG. 5 illustrates a case of connecting two such blocks B as arranged above in such a manner as to redirect the protrusion. Depending on into which recessed portion in which surface of the left block to fit the protrusion on the right block in FIG. 5(A), a connection state redirecting the protrusion can be obtained as shown in FIG. 5(B), for example.

Connection states redirecting the protrusion can thus be obtained and, by combining these states, various types of connection structures can also be obtained.

Figure 6:
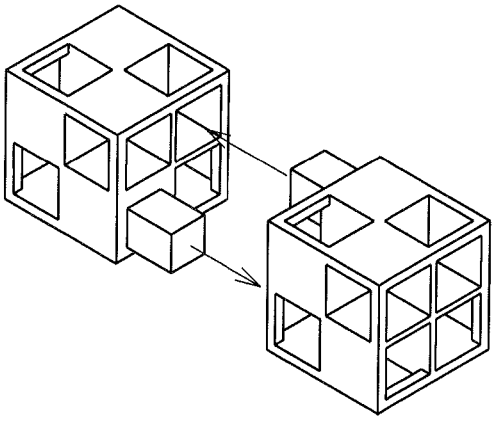
FIG. 6 illustrates connection structures of the connectable block according to the first embodiment.

FIG. 6 illustrates a case of connecting two such blocks B as arranged above in such a manner as to hide the protrusions. As shown in FIG. 6, a connection state hiding the protrusions can be obtained by fitting the protrusion on the left block into the recessed portion in the right block and fitting the protrusion on the right block into the recessed portion in the left block.

As exemplified in FIGS. 7 and 8, various three-dimensional connection structures can be obtained by combining such various types of connection states as described above.

In the case of connecting several types of different-colored blocks, color-coded three-dimensional connection structures can also be obtained by devising the arrangement of the blocks such that the three-dimensional structure is divided into segments by color.

Also, connection structures combined with transparent blocks or blocks with a built-in illuminant may serve as an interior item. Further, connection structures combined with blocks including wheels such as tires or body parts such as faces, eyes, and limbs may serve as a movable toy or a toy animal or doll.

The blocks may have various sizes. For example, the length of each side of small-sized ones may be about 20 mm, middlesized ones may be about 10 cm, and large-sized ones may be about 1 m. However, blocks having the same size should be basically connected.

Figure 7A:
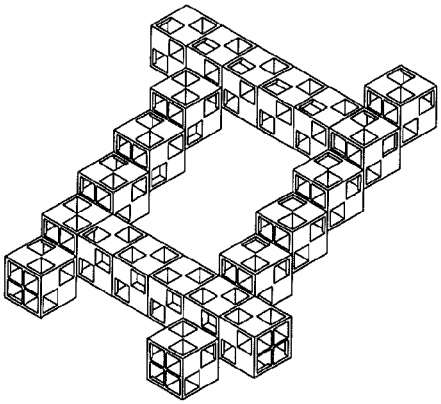
FIGS. 7(A)-7(E) show perspective views of various exemplary connection structures obtained by connecting connectable blocks according to the first embodiment.
Figure 7B:
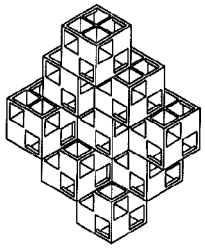
Figure 7C:
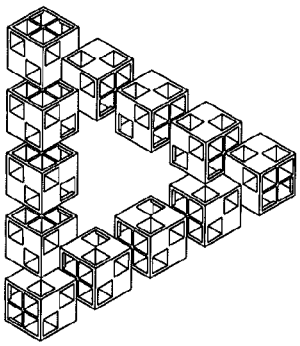
Figure 7D:
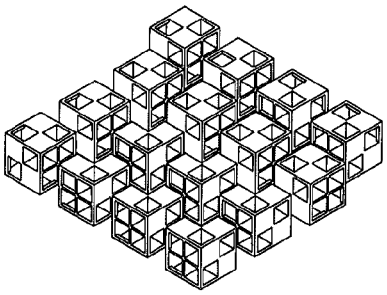
Figure 7E:
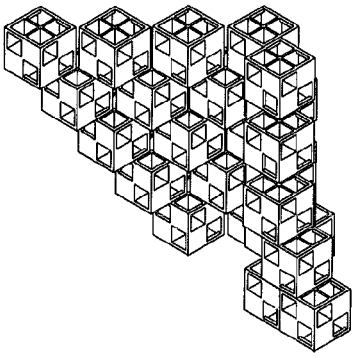
Figure 8A:
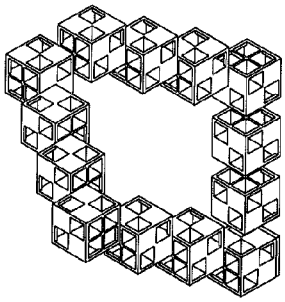
FIGS. 8(A)-8(E) show perspective views of various exemplary connection structures obtained by connecting connectable blocks according to the first embodiment.
Figure 8B:
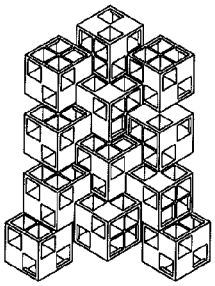
Figure 8C:
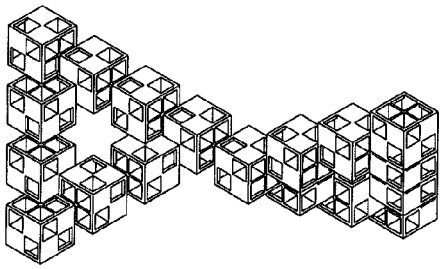
Figure 8D:
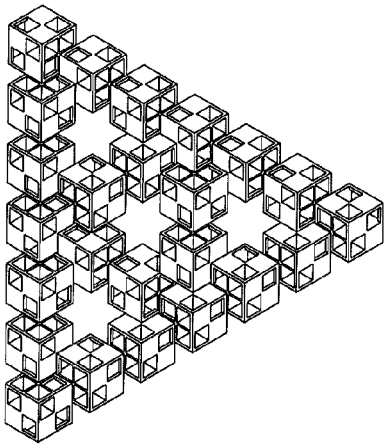
Figure 8E:
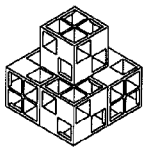

Twelve blocks, which are required to assemble the three-dimensional structure exemplified in FIG. 7(C), may be combined and sold in one set.

Second Embodiment

Figure 9:
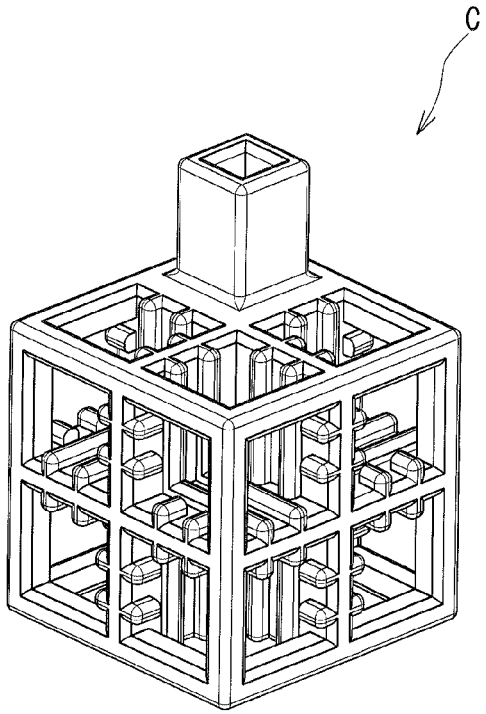
FIG. 9 is a perspective view of a connectable block according to a second embodiment.

In a block C according to a second embodiment, one protrusion is provided on one surface and four recessed portions are provided in each of the other five surfaces, as shown in FIG. 9.

Third Embodiment

Figure 10:
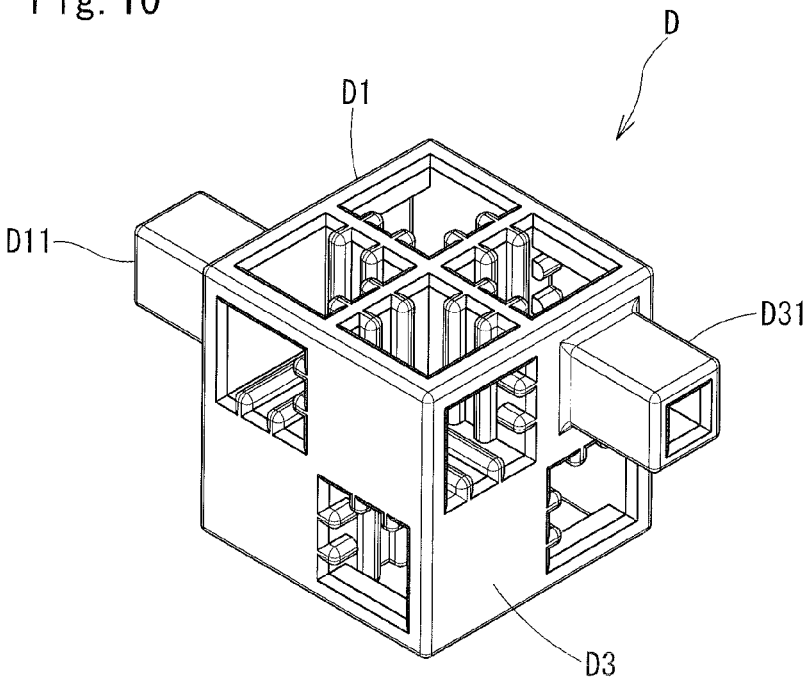
FIG. 10 is a perspective view of a connectable block according to a third embodiment.

In a block D according to a third embodiment, two surfaces have a protrusion provided thereon. As shown in FIG. 10, protrusions D11 and D31 are provided at the center in one quarter section of the respective first and third surfaces D1 and D3, a pair of surfaces parallel to each other among the six surfaces, and a recessed portion having a size into which a protrusion on another block is fittable is provided at the center in at least one of the other three quarter sections.

Fourth Embodiment

Figure 11:
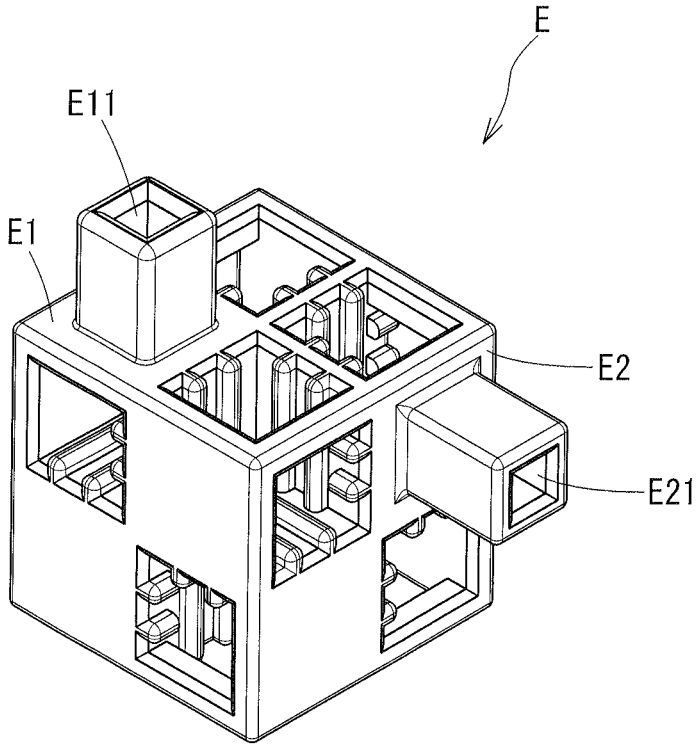
FIG. 11 is a perspective view of a connectable block according to a fourth embodiment.

In a block E according to a fourth embodiment, two surfaces have a protrusion provided thereon. As shown in FIG. 11, protrusions E11 and E21 are provided at the center in one quarter section of the respective first and second surfaces E1 and E2, two adjacent surfaces among the six surfaces, and a recessed portion having a size into which a protrusion on another block is fittable is provided at the center in at least one of the other three quarter sections.

As illustrated in the third and fourth embodiments above, the number of surfaces on which to provide a protrusion is not limited to one but may be two or three or more.

At least one recessed portion is enough to be provided in each surface. Alternatively, two to four recessed portions may be provided in each surface.

In any case, it is only necessary for each protrusion and recessed portion to be provided at the center in each quarter section of one surface.

What is claimed is:

1. A pair of blocks comprising:

a regular-hexahedral first block; and a second block connectable to the first block, wherein the second block has the same geometry as the first block, wherein the first block comprises:

first, second, third, fourth, fifth, and sixth surfaces;

a quadrangular columnar protrusion formed on the first surface of the first block at the center in one square quarter section of the surface, wherein the protrusion has a square cross-sectional shape;

a first recessed portion formed at the center in another square quarter section in the first surface; and a second recessed portion in the second surface, wherein the second recessed portion is formed at the center in one square quarter section of the second surface which is perpendicular to the first surface, and wherein the second recessed portion is internally connected to the first recessed portion, wherein a protrusion of the second block is inserted into and fit in one of the first and second recessed portions of the first block, and another of the first and second recessed portions of the first block is closed by the protrusion of the second block, wherein the first surface defines a recessed portion at the center of each square quarter section not having the quadrangular columnar protrusion, wherein each of the second, fourth, fifth, and sixth surfaces is perpendicular to the first surface, wherein each of the second, fourth, fifth, and sixth surfaces defines a total of two recessed portions formed at the center of two respective square quarter sections of the surface at least one of which is not internally connected to the first recessed portion and the other two square quarter sections of the second, fourth, fifth, and sixth surfaces have no recessed portions, and wherein each of the two recessed portions of the surface is adjacent each of the two of the square quarter sections having no recessed portions such that the two recessed portions are diagonal with respect to one another on the surface, and wherein the direction in which the recessed portions are formed diagonally in each of said second, fourth, fifth, and sixth surfaces being the same, wherein the two recessed portions internally connected to each other have common inner walls defining the recessed portions, and wherein the common inner walls include sets of parallel ribs in a direction of insertion of the other block into the recessed portion, wherein each recessed portion includes a first set of parallel ribs and a second set of parallel ribs orthogonal to the first set of parallel ribs.

2. The pair of blocks according to claim 1, wherein the protrusion of at least one of the first block and the second block is defined by a length such that when the protrusion is inserted into and fit in one of the first and second recessed portions of another of the first block and the second block, the protrusion is capable of contacting a bottom wall surface of the recessed portion of the block into which the protrusion is inserted.

3. The pair of blocks according to claim 1, wherein the protrusion of at least one of the first block and the second block has a substantially constant cross-section throughout a length of the protrusion.

* * * * *